United States Patent [19]

Roberts et al.

[11] 3,933,250

[45] Jan. 20, 1976

[54] GUY CRANE JIB TIP PROP

[76] Inventors: Alvin M. Roberts; Kenneth E. Roberts, both of 705 W. McBryde, Montesano, Wash. 98563

[22] Filed: Nov. 1, 1974

[21] Appl. No.: 519,823

[52] U.S. Cl. ..... 212/58 R

[51] Int. Cl.[2] ..... B66C 23/94

[58] Field of Search ..... 212/58 R, 49, 48, 35 R, 212/35 HC, 8 R, 8 B, 9; 214/86 A, 95 R

[56] References Cited

UNITED STATES PATENTS

| | | | |
|---|---|---|---|
| 2,354,740 | 8/1944 | Couse | 214/86 A |
| 2,598,517 | 5/1952 | Drott | 212/8 R |
| 2,907,473 | 10/1959 | Garnett | 212/8 R |
| 3,426,915 | 2/1969 | Tesch | 212/8 B |

*Primary Examiner*—Robert R. Song
*Attorney, Agent, or Firm*—Robert W. Beach

[57] ABSTRACT

To increase the working strength and stability of a guy jib crane, a prop supports the jib tip. The jib is articulated so that it can be folded for traveling of the crane, and the prop can be stowed alongside a folded section of the jib during travel of the crane.

6 Claims, 5 Drawing Figures

GUY CRANE JIB TIP PROP

This invention relates to guy jib cranes and more particularly to the provision of a prop for supporting the tip of the jib.

A principal object of the invention is to provide a guy jib crane which can haul and lift heavier loads than the usual guy jib crane of comparable weight and which is more stable in operation. More specifically it is an object to provide a guy jib crane having a comparatively light jib in relation to the strength of the crane.

A further object is to provide a guy jib crane having a prop which can be set easily and accurately and which can be shifted quickly and conveniently to the most desirable location for supporting the jib tip.

Another object is to provide a guy jib crane having an articulated jib that can be folded for travel of the crane and to enable the jib prop to be stowed conveniently during travel of the crane.

Figures 1, 2:
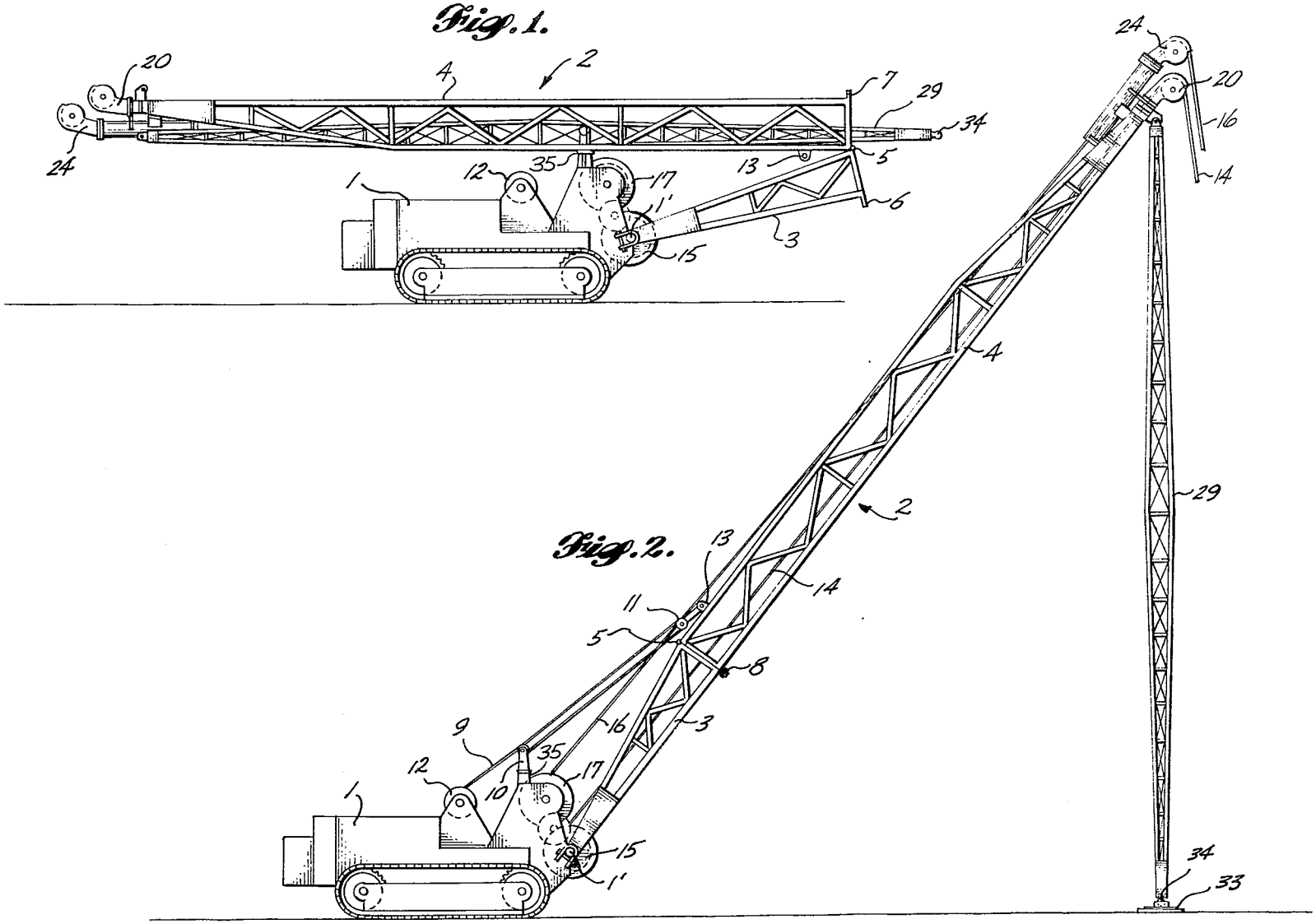
FIG. 1 is a side elevation of the crane in condition for travel.
FIG. 2 is a side elevation of the crane set up for operation.

The crane includes a mobile chassis 1, preferably of the crawler type, so that it is suitable for easy and accurate location for crane operation and so that it can be moved readily from one working location to another. The jib 2 of the crane is articulated and has a relatively short base section 3 having its lower end pivoted on the chassis 1 and a relatively long extension section 4 extendable upward from the base section. These sections can be constructed of three or four Warren truss panels joined in triangular or rectangular cross section.

The adjacent ends of the two sections are connected for relative folding movement by a hinge 5 at the upper side of the jib. On the upper end of the root jib section 3, a lug 6 projects from the lower side, opposite the hinge 5. On the adjacent end of the extension section 4, a mating lug 7 projects from the side opposite the hinge 5 so that when the extension section is in alignment with the root section the two lugs are in registration. These lugs can be apertured and secured together by a bolt 8 extending through registering apertures in the lugs 6 and 7 to secure the two jib sections in aligned relationship.

When the root section 3 and the extension section 4 have been integrated as described above to form the jib 2, the jib can be swung by the rigging line 9 into various positions inclined upwardly from the pivot 1′ supporting the lower end of the root section on the crane chassis. One end of rigging line 9 is anchored to a post 10 from which the line passes upward over a pulley 11 and is doubled back to be wound on the rigging drum 12 carried by the crane chassis. The pulley 11 is supported on a swingable mounting pivotally connected to a lug 13 on the extension section 4 of the jib, spaced a short distance from the hinge 5. The axis of the drum 12 is spaced from the axis of the jib-supporting pivot 1′ so that the jib can be swung upward by reeling in rigging line 9 and lowered by paying out such line.

Figure 4:
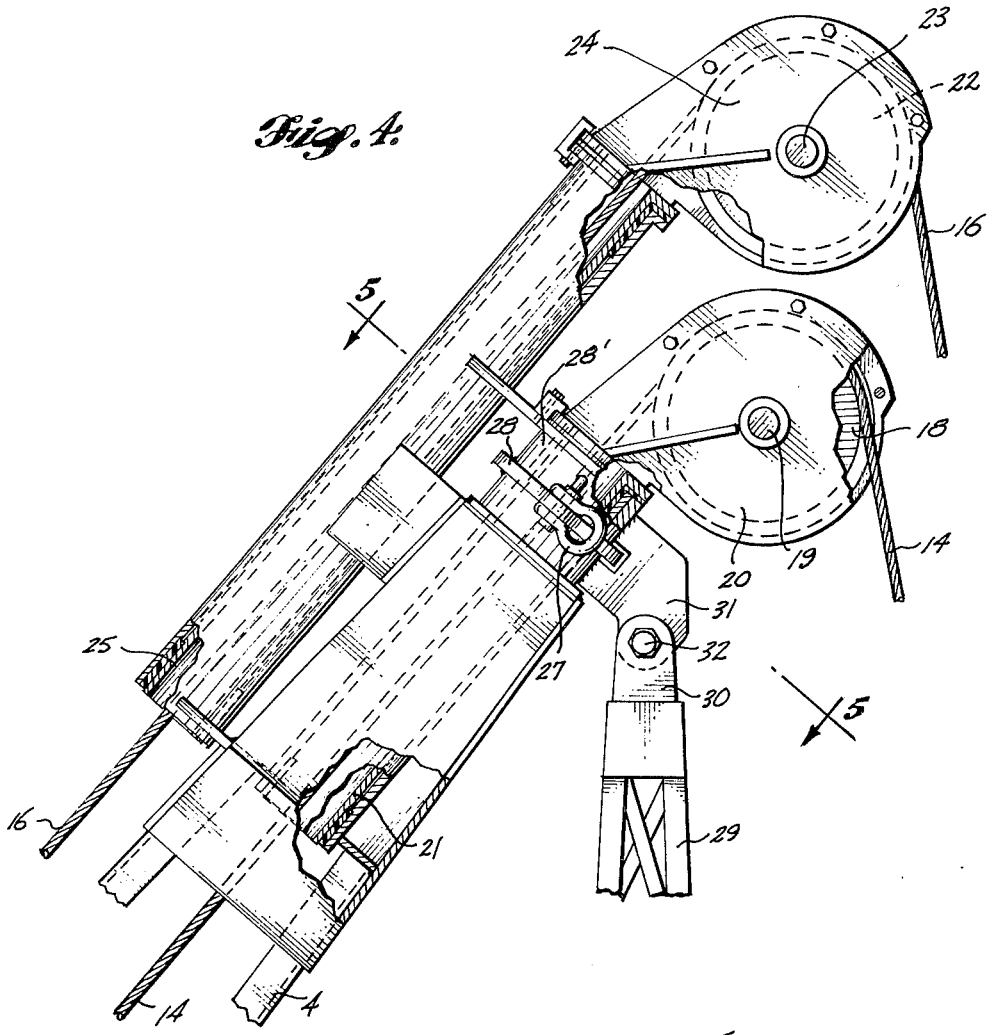
FIG. 4 is an enlarged detail side elevation of the tip portion of the crane showing swiveled hauling line and haulback fairleads.
Figure 5:
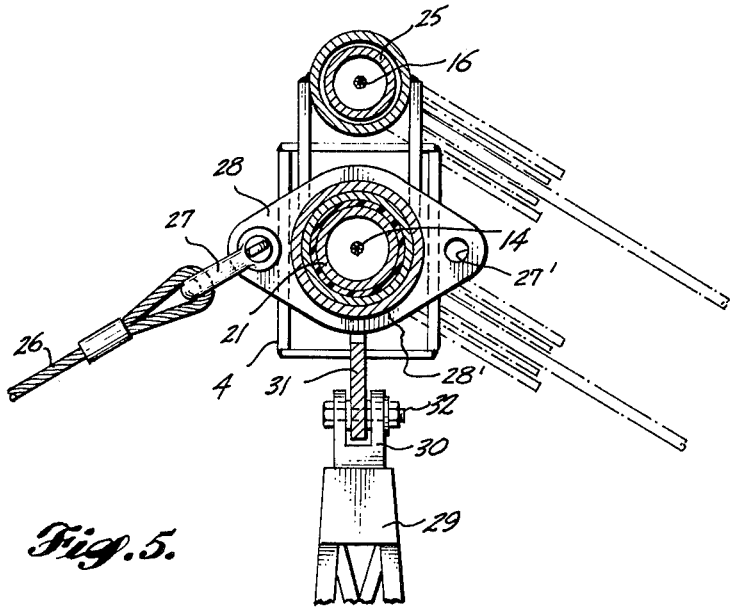
FIG. 5 is a transverse section through the structure of FIG. 4 taken on line 5—5 of FIG. 4.

When the guy jib crane is used as a yarder for logging operations, it is equipped with a hauling line 14 wound on a drum 15 and a haulback 16 wound on a drum 17. As shown best in FIG. 4, the hauling line runs over a pulley 18 of a swiveled fairlead mounted on the tip of the jib 2. Such pulley is journaled by a shaft 19 carried by the casing 20 which is mounted for swiveling relative to the jib tip by a swivel mount 21. Correspondingly, the haulback 16 runs over a pulley 22 of another swiveled fairlead. Such pulley is journaled by shaft 23 in the casing 24 carried by the swivel mount 25 mounted on the tip of the extension section of the jib.

The upper end of the jib is steadied and anchored by a guy line 26 connected by a shackle 27 to one of two opposite apertures 27′ in a plate 28 carried by a collar fitting 28′ on the tip of the jib. Alternatively, guy lines could be connected to both apertures. The upper end of a prop 29 carries a clevis 30 connected to a lug 31 of the same jib tip fitting by a bolt 32, enabling the prop to be adjusted angularly with respect to the jib. A bearing plate 33 (FIG. 2) supports the lower end of the prop 29 for universal tilting relative to it by a ball joint 34.

Figure 3:
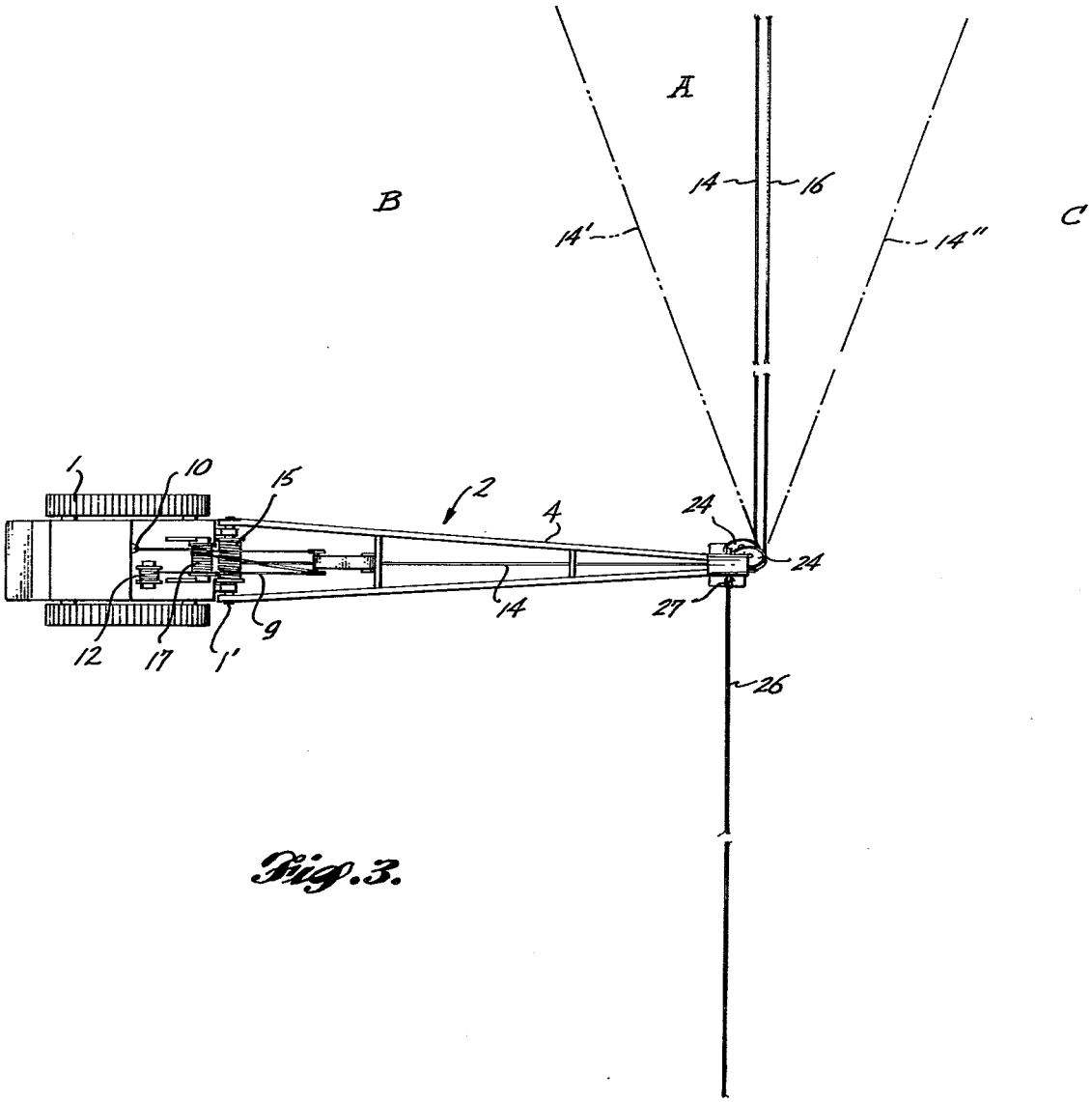
FIG. 3 is a plan of the crane rigged for yarding logs.

If the crane exerted a pulling force on the hauling line 14 in a vertical plane parallel to the jib 2, such pull would tend to draw down the upper end of the jib. Normally such drawing force would be counteracted only by the weight of the crane chassis. Installation of the prop 29 to support the tip of the jib from the ground will counteract the downward force on the tip of the jib exerted by the tension in hauling line 14 when pulling a load whether that line extends in a vertical plane substantially parallel to the jib or in a vertical plane transversely of the jib, as illustrated in FIG. 3, or in a vertical plane at any angle to the jib. The important consideration is that the vertical force vector of the tension in hauling line 14 acting downward is counteracted by the prop 29 rather than the crane.

It is difficult to insure that the hauling line 14 is always disposed in a vertical plane precisely parallel to the jib 2. When the vertical plane of the hauling line departs appreciably from parallelism with jib 2, such jib is subjected to a lateral force tending to tip the crane over. Consequently, it is preferred to guy the tip of the jib and to operate the hauling line 14 in a plane disposed at a substantial angle to the jib 2 and generally parallel to the guy line. Such an arrangement is illustrated in FIG. 3, in which the hauling line 14 and the haulback 16 extend in one generally horizontal direction laterally of the tip of crane jib 2 to one side of the jib, and the guy line 26 extends generally horizontally laterally to the other side of the jib from its tip and substantially directly opposite the hauling line 14.

With the crane rigged as illustrated in FIG. 3, the vertical vector of the hauling line 14 will be counteracted primarily by compression in the prop 29, so that the crane will not be subjected to an excessive tilting force. The horizontal vector of the tension in hauling line 14 will be counteracted almost entirely by the horizontal vector of the tension in guy line 26. The pull of the hauling line will actually swing the tip of the jib until the guy line 26 is taut.

It is desirable to position the crane so that it can yard from a reasonably large area. When positioned as shown in FIG. 3, it is practical for the hauling line 14 to extend from the crane jib in any direction between the direction 14′ and the direction 14″ shown in FIG. 3. The vector of the hauling line tension in a direction perpendicular to a vertical plane parallel to the guy line 26 will act parallel to the vertical plane of the jib 2, and such force can easily be carried by the crane jib. If the angle of the hauling line departs appreciably farther from a vertical plane perpendicular to the vertical plane of the jib 2 than lines 14' and 14'' in FIG. 3, the crane should be repositioned.

In positioning the yarding crane to perform a yarding operation, the crane should, of course, be approximately at the location to which it is desired to haul logs. With the construction of the present invention, logs can be yarded in a direction transversely of the length of the job. For such operation the crane should be located at the end of the area to which logs are to be hauled opposite the area from which logs are to be yarded. The crane should then be positioned so that the vertical plane of its jib is substantially perpendicular to a vertical plane through the center of the area from which the logs are to be yarded. The jib 2 can be swung to move its tip slightly away from the area from which the logs are to be hauled so that the lower end of guy line 26 can be easily secured on the ground.

To adjust the operating position of the crane precisely, the outer end of the hauling line 14 is anchored and the winch drum 15 is turned to tension the hauling line. The resultant pull on the hauling line will swing the tip of jib 2 slightly toward the yarding area until guy line 26 is taut. The pull on the hauling line is then slackened, and the rigging line 9 is reeled in sufficiently to raise jib 2 which, in turn, will raise prop 29 sufficiently to free the bearing plate 33 from ground contact. The prop 29 will then swing to precisely upright position, after which the rigging line 9 is paid out sufficiently to lower the prop 29 again so that it is supported by bearing plate 33 on the ground and rigging line 9 is relieved of substantially all stress.

The crane will now be in condition for performing the yarding operation by manipulating the hauling line 14 and the haulback 16. The reaction forces to pulling on line 14 will be provided almost entirely by the prop 29 and the guy line 26. Despite the fact that the pull on the hauling line is substantially perpendicular to the jib 2, such jib will not be required to provide any substantial reaction to the pulling force of the hauling line.

Lines 14' and 14'' in FIG. 3 represent the limits of the angle which the plane of hauling line 14 vary relative to the plane of guy line 26 for safe yarding. In the position of the crane shown in FIG. 3, the safe yarding area is indicated as A. If it should be desirable to extend the yarding area B to the left of line 14' shown in FIG. 3, the crane can be repositioned to yard safely in this area without reanchoring the guy line 26. For such operation it is merely necessary to haul in rigging line 9 for swinging jib 2 upwardly sufficient to raise the lower end of prop 29 from the ground, after which the crane chassis can be driven rearwardly a short distance to swing the guy line 26 so that it is directed toward the center of area B, whereupon rigging line 9 is slackened to lower prop 29 onto the ground again.

Conversely, if it should be desired to yard from the area C to the right of line 14'', as shown in FIG. 3, the crane again can be repositioned without reanchoring the guy line 26. In this instance the drum 12 is turned to reel in rigging line 9 until the jib 2 is raised sufficiently to lift the prop 29 clear of the ground, after which the crane chassis is driven forward a short distance to direct guy line 26 toward the area C. The rigging line 9 is then again slackened so that the jib 2 will be lowered to reset prop 29 on the ground.

If it is desired to utilize the equipment for yarding in a different area, the two winch drums 15 and 17 are turned to haul in the hauling line 14 and the haulback 16 so that these lines are wound in completely onto the respective drums 15 and 17. In order to place the crane in position for travel as shown in FIG. 1, it is desirable for the jib and prop to be laid substantially horizontally and to be located substantially centrally above the crane chassis. The lengths of the jib root section 3 and of the extension section 4 are selected so that the extension section will be approximately centered over the chassis when one end of the root section is still attached to the adjacent end of the extension section and the other end of the root section is still pivoted to the chassis. When the extension section 4 is folded double relative to the root section 3 into a substantially horizontal traveling position as shown in FIG. 1, the extension section of the jib can rest on a seat 35 carried by the upper portion of the crane chassis.

In order to convert the crane from the operative position of FIG. 2 to the traveling condition of FIG. 1 the rigging line 9 is reeled in for tilting the jib 2 upward to raise prop 29 off the ground. The prop can then be folded back against the lower side of the extension section 4 and secured in place while the upper ends of such jib section and prop are still pivotally connected together. The rigging line 9 can now be paid out to lower the jib into a horizontal position so that a second guy line can be attached to the other aperture in plate 28 to extend oppositely from guy line 26 for steadying the jib sidewise during swinging of the jib to traveling position.

To swing the jib to traveling position, the hauling line 16 is secured to the lower end of the prop. The bolt 8 is removed to enable lugs 6 and 7 to separate. Drum 12 is then turned to wind in the rigging line 9 for swinging the extension section 4 of the jib counterclockwise relative to the root section 3 as seen in FIG. 2, while maintaining tension on the hauling line 16 to hold the extension section 4 and prop 29 up and prevent uncontrolled falling of the jib extension section into the position shown in FIG. 1.

After the extension section 4 of jib 2 and the prop 29 have swung in the clockwise direction about pivot 5 beyond the vertical position, the hauling line 16 is paid out slowly to ease the extension jib section and the prop down into the position of the extension section shown in FIG. 1. The pivot bolt 32 connecting the prop and the extension jib section can then be removed so that the prop can be positioned as desired, or the prop could be left attached to the extension section for travel.

When the new location in which the crane is to be operated has been reached, the clevis 30 of the prop 29 again is attached to the lug 31 of the jib fitting by a bolt 32 if the prop had previously been disconnected from the jib. The hauling line 16 is then attached to the lower end of the prop, and the drum 17 turned to wind in such line for swinging the prop and extension jib section 4 in a clockwise direction, as seen in FIG. 1, about pivot 5, while being steadied laterally by the opposite guy lines. When the prop and extension section have been swung to an upright position, the rigging line 9 can be paid out to lower the extension to a substantially horizontal position. The lugs 6 and 7 will then be in mating relationship so that the bolt 8 can be inserted through their apertures to reconnect them, and the extra guy line 26 can be detached from fitting plate 28. The jib is now ready to be raised by reeling in rigging line 9 to a position such as shown in FIG. 2, whereupon the prop 29 can be released from the extension section to swing to its upright jib-supporting position. The guy line 26, hauling line 14 and haulback 16 can then be arranged as shown in FIG. 3, preparatory to performing the new yarding operation.

We claim:

1. In a guy jib crane comprising a crane jib, an upright prop supporting the tip of said crane jib, a hauling line extending in one generally horizontal direction laterally of said crane jib from its tip, and a guy line extending generally horizontally laterally from the tip of said crane jib generally in the direction opposite said hauling line.

2. In the guy jib crane defined in claim 1, a swiveling fairlead carried by the jib tip through which the hauling line extends.

3. In the guy jib crane defined in claim 1, a fitting carried by the jib tip to which the guy line and the prop are connected.

4. In the guy jib crane defined in claim 3, pivot means connecting the jib tip fitting and the upper portion of the prop for swinging of the prop relative to the jib.

5. A roadable jib crane comprising a traveling chassis movable in a predetermined direction, and an articulated jib including a root section, pivot means mounting said root section on one end of said chassis for swinging relative thereto about an axis extending transversely of such direction of movement of said chassis into a generally horizontal traveling position with its length extending fore and aft of said chassis and an extension section hingedly connected to said root section for folding relative thereto into a generally horizontal traveling position with its length extending fore and aft of said chassis.

6. The roadable jib crane defined in claim 5, and a prop for supporting the jib of the extension section and being movable into generally horizontal stowed position with its length extending fore and aft of the chassis alongside the extension section of the jib in its traveling position.

* * * * *